US006011944A

United States Patent [19]

Nilsson

[11] Patent Number: 6,011,944

[45] Date of Patent: Jan. 4, 2000

[54] PRINTHEAD STRUCTURE FOR IMPROVED DOT SIZE CONTROL IN DIRECT ELECTROSTATIC IMAGE RECORDING DEVICES

[75] Inventor: Daniel Nilsson, Göteborg, Sweden

[73] Assignee: Array Printers AB, Vastra Frolunda, Sweden

[21] Appl. No.: 08/757,972

[22] Filed: Dec. 5, 1996

[51] Int. Cl.[7] ..... G03G 15/08

[52] U.S. Cl. ..... 399/258; 347/55

[58] Field of Search ..... 347/55, 112, 141; 399/358

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-7563 | 7/1980 | Japan . |
| 56-89576 | 7/1981 | Japan . |
| 58-044457 | 3/1983 | Japan . |
| 58-155967 | 9/1983 | Japan . |
| 62-248662 | 10/1987 | Japan . |
| 62-13356 | 11/1987 | Japan . |
| 01120354 | 5/1989 | Japan . |
| 6329795 | 5/1990 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 7-186435 | 7/1995 | Japan . |
| 8-058143 | 3/1996 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

OTHER PUBLICATIONS

E. Bassous, et al., "The Fabrication of High Precision Nozzles by the Anisotropic Etching of (100) Silicon", *J. Electrochem. Soc.: Solid–State Science and Technology,* vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

*Primary Examiner*—Arthur T. Grimley
*Assistant Examiner*—Quana Grainger
*Attorney, Agent, or Firm*—Knobbe, Martens, Olson & Bear, LLP

[57] ABSTRACT

A printhead structure for a direct electrostatic printing device selectively conveys a stream of charged toner particles from a particle source directly onto an image receiving substrate. The printhead structure includes an electrode plate having openings which surround the apertures. A voltage applied to the electrode plate causes a converging electric field to applied to the toner particles passing through the apertures. The converging electric field causes the toner particles to converge toward respective central axes of the apertures to thereby focus the stream of toner particles. The focusing of the toner particles considerably reduces the dot sizes on the printed image. The use of the printhead structure results in increased print resolution and improved image quality.

21 Claims, 6 Drawing Sheets

U.S. PATENT DOCUMENTS 3,779,166 12/1973 Pressman et al. .
3,815,145 6/1974 Tisch et al. .
4,263,601 4/1981 Nishimura et al. .
4,274,100 6/1981 Pond .
4,320,408 3/1982 Iwasa et al. ..... 347/55
4,353,080 10/1982 Cross .
4,382,263 5/1983 Fischbeck et al. .
4,384,296 5/1983 Torpey .
4,386,358 5/1983 Fischbeck .
4,470,056 9/1984 Galetto et al. .
4,478,510 10/1984 Fujii et al. .
4,491,794 1/1985 Fujii et al. ..... 347/55
4,491,855 1/1985 Fujii et al. .
4,498,090 2/1985 Honda et al. .
4,511,907 4/1985 Fukuchi .
4,525,708 6/1985 Hareng et al. .
4,525,727 6/1985 Kohashi et al. .
4,571,601 2/1986 Teshima .
4,675,703 6/1987 Fotland .
4,717,926 1/1988 Hotomi .
4,743,926 5/1988 Schmidlin et al. .
4,748,453 5/1988 Lin et al. .
4,814,796 3/1989 Schmidlin .
4,831,394 5/1989 Ochiai et al. .
4,837,071 6/1989 Tagoku et al. .
4,860,036 8/1989 Schmidlin .
4,903,050 2/1990 Schmidlin .
4,912,489 3/1990 Schmidlin .
4,922,242 5/1990 Parker .
5,028,812 7/1991 Bartky .
5,036,341 7/1991 Larsson .
5,038,159 8/1991 Schmidlin et al. .
5,057,855 10/1991 Damouth .
5,072,235 12/1991 Slowik et al. .
5,083,137 1/1992 Badyal et al. .
5,095,322 3/1992 Fletcher .
5,121,144 6/1992 Larson et al. .
5,128,695 7/1992 Maeda .
5,148,595 9/1992 Doggett et al. .
5,170,185 12/1992 Takemura et al. .
5,181,050 1/1993 Bibl et al. .
5,204,696 4/1993 Schmidlin et al. .
5,204,697 4/1993 Schmidlin .
5,214,451 5/1993 Scmidlin et al. .
5,229,794 7/1993 Honma et al. ..... 347/55
5,235,354 8/1993 Larson .
5,237,346 8/1993 Da Costa et al. .
5,256,246 10/1993 Kitamura .
5,257,045 10/1993 Bergen et al. .
5,270,729 12/1993 Stearns .
5,274,401 12/1993 Doggett et al. .
5,307,092 4/1994 Larson .
5,329,307 7/1994 Takemura et al. .
5,374,949 12/1994 Wada et al. .
5,386,225 1/1995 Shibata .
5,402,158 3/1995 Larson .
5,414,500 5/1995 Furukawa .
5,446,478 8/1995 Larson .
5,450,115 9/1995 Bergen et al. .
5,453,768 9/1995 Schmidlin .
5,473,352 12/1995 Ishida .
5,477,246 12/1995 Hirabayashi et al. .
5,477,250 12/1995 Larson .
5,506,666 4/1996 Masuda et al. .
5,508,723 4/1996 Maeda .
5,515,084 5/1996 Larson .
5,526,029 6/1996 Larson et al. .
5,558,969 9/1996 Uyttendaele et al. .
5,559,586 9/1996 Wada .
5,600,355 2/1997 Wada .
5,614,932 3/1997 Kagayama .
5,617,129 4/1997 Chizuk, Jr. et al. .
5,625,392 4/1997 Maeda .
5,640,185 6/1997 Kagayama .
5,650,809 7/1997 Kitamura .
5,666,147 9/1997 Larson .
5,677,717 10/1997 Ohashi .
5,708,464 1/1998 Desie .
5,805,185 9/1998 Kondo .
5,818,480 10/1998 Bern et al. .
5,818,490 10/1998 Larson .
5,847,733 12/1998 Bern .

PRINTHEAD STRUCTURE FOR IMPROVED DOT SIZE CONTROL IN DIRECT ELECTROSTATIC IMAGE RECORDING DEVICES

BACKGROUND OF THE INVENTION

1. Field of the Invention

The invention relates to a printhead structure in a direct electrostatic printing device in which printing is carried out by selectively conveying charged toner particles from a particle source directly onto an image receiving substrate. More specifically, the invention relates to a printhead structure including means for focusing the streams of toner particles conveyed from the particle source towards the image receiving substrate, thereby considerably reducing the dot size of the printed image, resulting in increased print resolution and improved print quality.

2. Description of the Related Art

Of the various electrostatic printing techniques, the most familiar and widely utilized is xerography, wherein latent electrostatic images formed on a charge retentive surface, such as a roller, are developed by a toner material to render the images visible, the images being subsequently transferred to plain paper. This process is called an indirect process since the visible image is first formed on an intermediate photoreceptor and then transferred to a paper surface.

Another method of electrostatic printing is one that has come to be known as direct electrostatic printing, DEP. This method differs from the aforementioned xerographic method in that charged toner particles are deposited directly onto an information carrier to form a visible image. In general, this method includes the use of electrostatic fields controlled by addressable electrodes for allowing passage of toner particles through selected apertures in a printhead structure. A separate electrostatic field is provided to attract the toner particles to an image receiving substrate in image configuration.

The novel feature of direct electrostatic printing is its simplicity of simultaneous field imaging and toner transport to produce a visible image on the substrate directly from computer generated signals, without the need for those signals to be intermediately converted to another form of energy such as light energy, as is required in electrophotographic printers, e.g., laser printers.

U.S. Pat. No. 5,036,341 granted to Larson discloses a direct electrostatic printing device and a method to produce text and pictures with toner particles on an image receiving substrate directly from computer generated signals. According to that method, a control electrode array is positioned between a back electrode and a rotating particle carrier. An image receiving substrate, such as paper, is then positioned between the back electrode and the control electrode array.

An electrostatic field from an electric potential on the back electrode attracts the toner particles from the surface of the particle carrier to create particle streams toward the back electrode. The particle streams are modulated by voltage sources which apply an electric potential to selected control electrodes of the control electrode array to create electric fields which permit or restrict transport of toner particles from the particle carrier. In effect, these electric fields open or close selected apertures in the control electrode array to the passage of toner particles by influencing the attractive force from the back electrode. The modulated streams of charged particles allowed to pass through selected apertures impinge upon an image receiving substrate interposed in the particle stream to provide line-by-line scan printing to form a visible image.

The control electrode array described in the above-mentioned patent is in the form of a lattice of individual wires arrange in rows and columns. A control electrode array operating according to the described principle may, however, take on any one of several other designs. Generally, the array is a thin sheet-like element, referred to as a Flexible Printed Circuit or FPC, comprising a plurality of addressable control electrodes and corresponding voltage signal sources connected thereto for attracting charged toner particles from the surface of a particle carrier to an image receiving substrate. A sequence of electronic signals, defining the image information, is converted into a pattern of electrostatic fields which locally modify the uniform field from the back electrode, thereby selectively permitting or restricting the transport of charged particles from the particle carrier and producing an image pattern corresponding to the electrostatic field pattern onto the image receiving substrate.

A flexible control array or FPC as discussed in, for example, U.S. Pat. No. 5,121,144, also granted to Larson, is made of a flexible, electrically insulated, nonrigid material, such as polyimide, or the like, which is provided with a multiplicity of apertures and overlaid with a printed circuit whereby the apertures in the material are arranged in rows and columns and surrounded by ring-shaped electrodes. A uniform electrostatic field generated by a back electrode attracts toner particles from a particle carrier to create a particle stream through the FPC toward the back electrode. All control electrodes are initially at a white potential $V_w$ which means that particle transport from the particle carrier toward the back electrode is inhibited. As image locations on an image receiving substrate pass beneath the apertures, selected control electrodes are set to a black potential $V_b$ to produce an electrostatic field drawing the toner particles from the particle carrier. Charged toner particles allowed to pass through the apertures in the FPC are subsequently deposited on the substrate in the configuration of the desired image pattern. The toner particle image is then made permanent by using heat and pressure to fuse the toner particles on the surface of the substrate.

Print resolution is determined by the number of distinguishable dots that can be printed per length unit across the image receiving substrate. Therefore, to meet the requirements of increased print resolution, it is essential to improve the control function in order to provide sufficiently small dots. For instance, to obtain a print resolution of 600 dots per inch (DPI), the overlap width of two adjacent dots might not exceed 1/600 inch, i.e., about 42 microns, and the size of a distinct dot might be in the order of 60 to 80 microns.

A drawback of the above-mentioned method is that the electrostatic fields controlling toner transport are not sufficiently convergent to create as small dots as are required for higher resolution print. In effect, the aperture size is typically in the order of 100 to 150 microns in diameter. The dot size can be decreased by reducing the amount of toner passing through the aperture to provide dots which are significantly smaller than the aperture. However, that may not only influence the dot size, but even considerably alter the dot density and uniformity.

Another drawback of the above-mentioned method is that, although the control electrodes have preferably a symmetric shape about a central axis of the apertures, the electric field configuration in the vicinity of an aperture may not be perfectly symmetrical due to interaction with adjacent connectors joining the control electrodes to the control unit, resulting in that toner particles may be slightly deflected from their initial trajectory, forming displaced dots on the image receiving substrate.

Another drawback of the above-mentioned method is that an electrostatic field generated by a control electrode may influence other apertures than the intended aperture, causing undesired dot size variation due to the neighboring field configuration (cross-talk).

Therefore, Applicant has perceived a need to improve a printhead structure in order to obtain dot sizes that satisfy the requirements of higher print resolution, for instance, a print resolution of 600 DPI or higher, and eliminates or at least considerably reduces dot deflection and cross-talk.

SUMMARY OF THE INVENTION

The present invention satisfies a need for higher print resolution and improved dot size control in direct electrostatic printing device.

The present invention relates to an image recording device in which charged toner particles are deposited in an image configuration on an image receiving substrate.

The image recording device includes at least one print zone comprising a particle source arranged adjacent to a back electrode; a background voltage source connected to the back electrode to produce an electric field between the particle source and the back electrode; an image receiving substrate interposed between the particle source and the back electrode; and a printhead structure arranged between the particle source and the image receiving substrate for controlling the transport of charged toner particles from the particle source.

The printhead structure includes an array of addressable control electrodes connected to variable voltage sources to produce a pattern of electrostatic fields which, in response to control in accordance with the image configuration, influence the electric field from the back electrode in order to selectively permit or restrict transport of charged toner particles from the particle source toward the image receiving substrate.

The printhead structure further includes at least one set of focusing means, arranged in electric cooperation with the control electrodes to influence the convergence of each electrostatic field in order to focus charged toner particles transported toward the image receiving substrate.

According to a preferred embodiment of the present invention, the printhead structure is composed of a substrate layer made of an electrically insulating, flexible material, such as polyimide, or the like, having dielectric properties and sufficient flexibility. The substrate layer has a first surface facing the particle source and a second surface facing the image receiving substrate. A plurality of apertures, arranged through the substrate layer, are surrounded by control electrodes arranged on the first surface of the substrate layer. The control electrodes are connected to variable voltage sources which supply a stream of signals, defining the image information, to the control electrodes to produce a pattern of electrostatic fields which selectively permit or restrict the transport of charged toner particles from the particle source through the apertures in accordance with the image configuration. The second surface of the substrate layer is partially overlaid with at least one conductive element, such as an electrode plate, having a plurality of openings surrounding the apertures of the substrate layer. Each such opening is preferably arranged symmetrically about the central axis of its corresponding aperture to apply a converging electric field on charged toner particles passing through the aperture. As toner particles are exposed to the converging electric field from the electrode plate, the charged toner particles are caused to converge toward the central axis of the aperture during transport toward the image receiving substrate, resulting in that each amount of toner particles transported form the particle source is focused to a small dot location on the image receiving substrate. The converging electric field is generated by at least one focusing voltage source connected to the electrode plate for supplying an electric potential which acts to repel charged toner particles around the apertures, thereby even shielding the transported toner particles from interaction with adjacent electrostatic fields.

Still according to a preferred embodiment of the present invention, a protective layer of electrically insulating material, such as parylene or the like, is arranged on both surfaces of the substrate layer, such that the control electrodes are embedded between the first surface of the substrate layer and the protective layer, the conductive layer is embedded between the second surface of the substrate layer and the protective layer and the inner wall of each aperture is coated with a protective layer.

The present invention further relates to a direct electrostatic printing method in which charged toner particles are transported from a particle source and deposited in image configuration on an image receiving substrate. The method includes the steps of conveying charged toner particles to a particle source located adjacent to a back electrode; connecting a background voltage source to the back electrode to produce an attractive electric field between the particle source and the back electrode; interposing an image receiving substrate between the particle source and the back electrode; positioning the particle source and the back electrode; positioning a printhead unit between the particle source and the image receiving substrate for controlling the transport of charged toner particles from the particle source, the printhead structure including control electrodes and at least one conductive element; connecting variable voltage sources to the control electrodes to produce a pattern of electrostatic fields which, in response to control in accordance with the image configuration, selectively permit or restrict the transport of charged toner particles from the particle source; and connecting at least one voltage source to the conductive element to produce converging electric fields which focus the charged toner particles as they are transported toward the image receiving substrate.

The present invention will become more fully understood from the detailed description given hereinbelow and the accompanying drawings which are given by way of illustration only, and, thus, are not limitative of the present invention.

DETAILED DESCRIPTION OF THE PREFERRED EMBODIMENT

Figure 1:
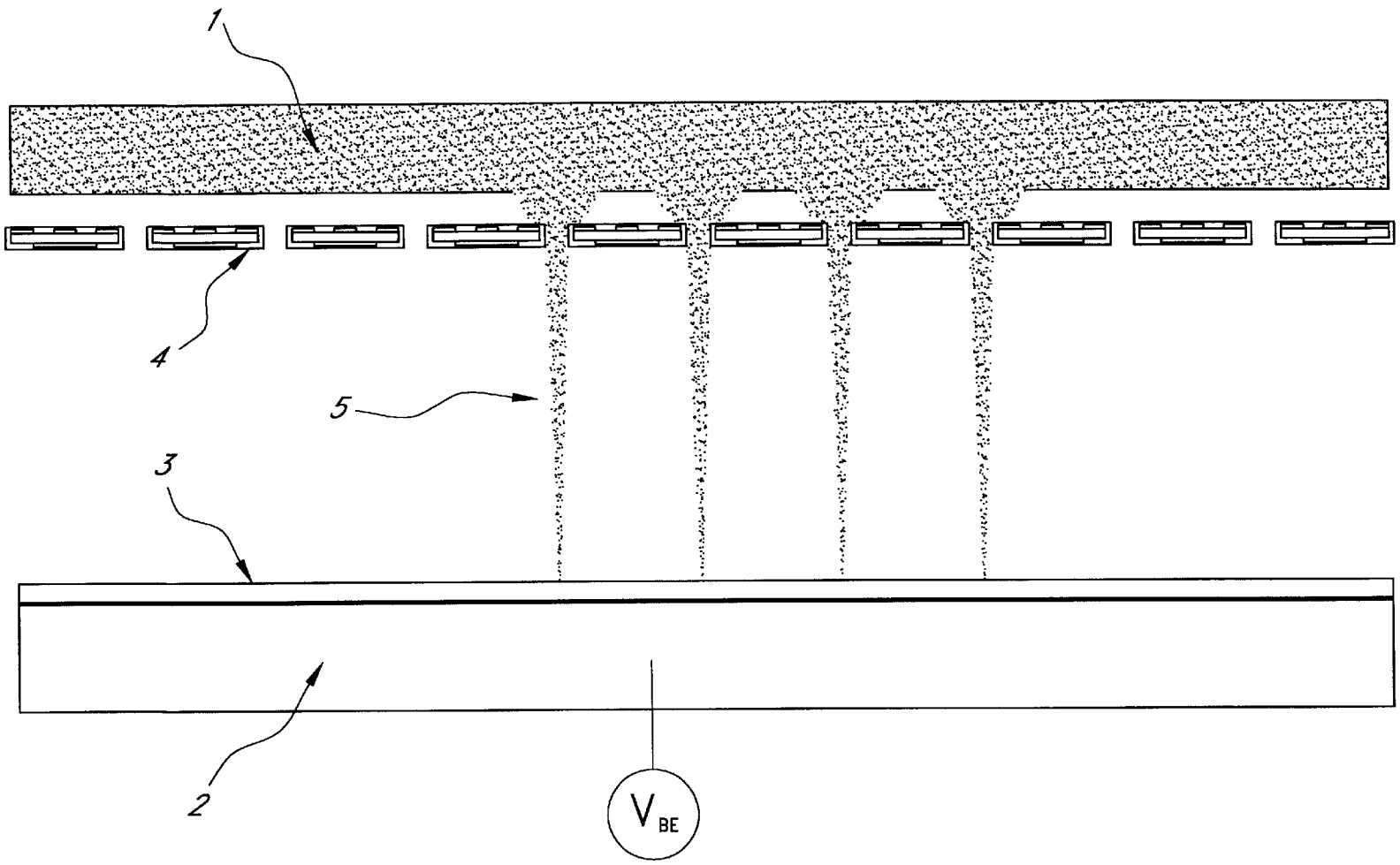
FIG. 1 is a simplified section view of an image recording device based on the present invention, showing schematically the particle source, the image receiving substrate and the printhead structure interposed therebetween.

FIG. 1 is a section view across the print zone in an image recording device for direct electrostatic printing based on the present invention. The print zone includes a particle source 1 in electric cooperation with a back electrode 2; an image receiving substrate 3 such as a sheet of plain, untreated paper caused to move between the particle source 1 and the back electrode 2; and a printhead structure 4 interposed between the particle source 2 and the image receiving substrate 3 to modulate the transport of charged toner particles 5 toward the image receiving substrate 3 in accordance with an image configuration.

The particle source 1 is preferably a rotating cylindrical sleeve having a rotational axis extending transversely across the print zone which is arranged perpendicularly to the motion of the image receiving substrate 3. Charged toner particles 5 are conveyed to the particle source 1 by means of a toner delivery unit (not shown).

A uniform electric field is produced between a first potential (preferably 0 V) on the particle source 1 and a background potential $V_{BE}$ on the back electrode 2 to apply an attractive electric force on the charged toner particles 5. A pattern of electrostatic fields is generated on the printhead structure 4 to at least partially open or close passages in the printhead structure 4 as the image locations on the image receiving substrate 3 pass beneath the particle source 1, whereas the charged toner particles 5 are exposed to the attractive force from the back electrode 2 through the opened passages. During transport from the printhead structure 4 toward the image receiving substrate 3, the toner particles 5 are exposed to converging forces from a focusing element.

Image recording devices include generally several print zones, each of which corresponds to a specific color of the toner particles. The image receiving substrate 3 is then fed in a single path consecutively through the different print zones whereas dots of different colors are superposed on the image receiving substrate 3 to form a colored image configuration. However, since the object of the present invention is identical for all print zones, regardless of the specific color of the toner, the invention is described with reference to a single print zone (FIG. 1).

Figure 2:
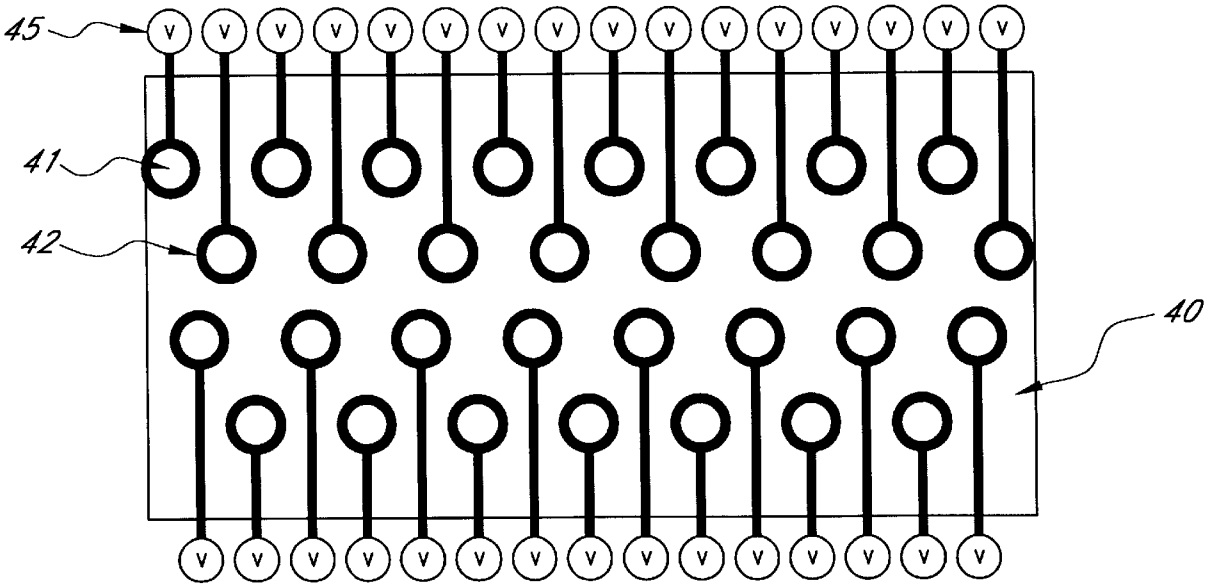
FIG. 2 is a schematic plane view of a control side of a printhead structure showing an array of control electrodes disposed in accordance with a preferred embodiment of the present invention.

FIG. 2 is an enlarged, partial plane view of a printhead structure 4. The printhead structure includes a substrate layer 40 of electrically insulating material having a first surface facing the particle source 1, a second surface facing the image receiving substrate 3, and a plurality of apertures 41 arranged through the substrate layer 40 to enable particle passage through the printhead structure 4. The substrate layer 40 is preferably made of a thin sheet of flexible, nonrigid material such as polyamide, polyimide, or the like, which is overlaid with a printed circuit of control electrodes 42 etched on the first surface. Note that FIG. 2 is viewed looking through the substrate layer 40 toward the particle source 1 so that the apertures 41 are illustrated as being aligned with the apertures 41 in FIGS. 3–5 described below. It should be understood that when the substrate 40 is viewed facing the first surface, the apertures 41 will be in mirrored locations about a horizontal center line.

Figure 3:
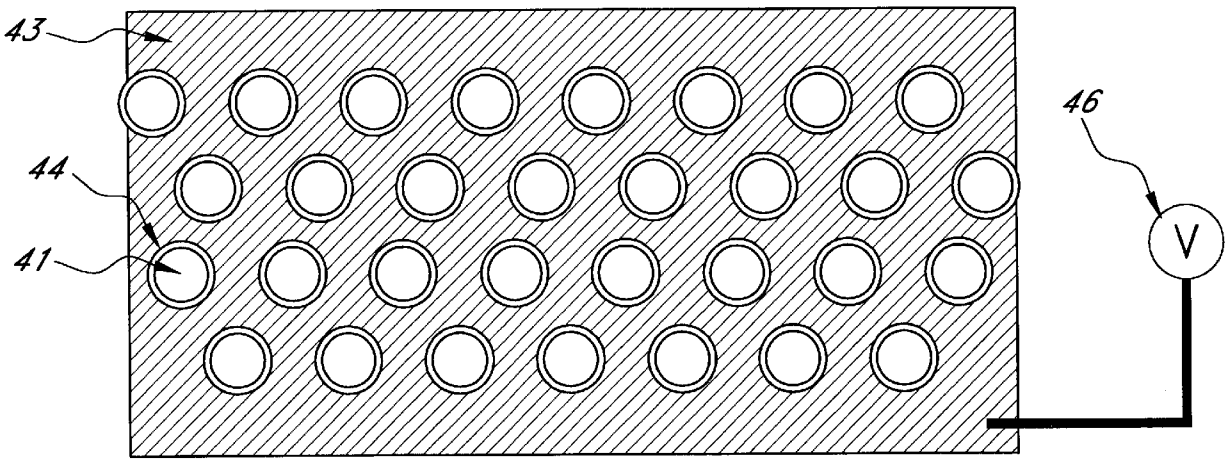
FIG. 3 is a schematic plane view of a focusing side of a printhead structure showing a conductive layer disposed in accordance with a preferred embodiment of the present invention.

The second surface, shown in FIG. 3, is coated with a layer of conductive material 43 having openings 44 surrounding the apertures 41 of the substrate layer 40. Control electrodes 42 are connected to variable voltage sources 45 which supply electric potentials chosen to be above or below a predetermined threshold value in order to open or close an aperture 41 for print or no print, respectively, to allow passage of charged toner particles 5 through the opened apertures as the image locations on the image receiving substrate 3 pass beneath the apertures 41. The conductive layer 43 is connected to at least one focusing voltage source 46 to focus the stream of toner particles 5 toward the image receiving substrate 3.

The apertures 41 have substantially cylindrical shapes, each having a central axis extending perpendicular to the image receiving substrate 3. Each aperture 41 has a first circular orifice facing the particle source 1, a second circular orifice facing the image receiving substrate 3 and an inner wall preferably coated with a protective layer of electrically insulating material. The first orifice is at least partially surrounded by a ring-shaped control electrode 42 having symmetry about the central axis of the aperture. The second orifice is at least partially surrounded by a circular opening 44 in the conductive layer 43. The control electrodes 42 are individually connected to variable voltage sources 45 generating electric potentials which are chosen to be above or below a predetermined threshold value for print or no print, respectively. The conductive layer 43 is connected to at least one focusing voltage source 46 generating a constant or periodic electric signal which is chosen to act to repel the charged toner particles.

As is apparent from FIGS. 2 and 3, the apertures 41 are preferably arranged in parallel rows and columns. The parallel rows of apertures 41 are aligned perpendicularly to the feed motion of the image receiving substrate 3. The columns are arranged at a slight angle to the motion of the image receiving substrate 3 to ensure complete coverage of the image receiving substrate 3 by providing an addressable dot position at every point across a line in a direction transversal to the feed movement of the image receiving substrate 3. The apertures 41 are preferably circular and surrounded by a ring shaped control electrode 42 etched on the first surface of the substrate layer 40 symmetrically about a central axis of each aperture 41.

The voltage sources 45 are included in a control unit that converts the image information into a pattern of electrostatic fields. The magnitudes of the electrostatic fields and the periods during which they are applied (pulse width) are modulated in relation to the amount of toner particles intended to pass through a selected aperture to form dots of variable density corresponding to different shades between white (no print) and maximal color intensity.

Figure 4:
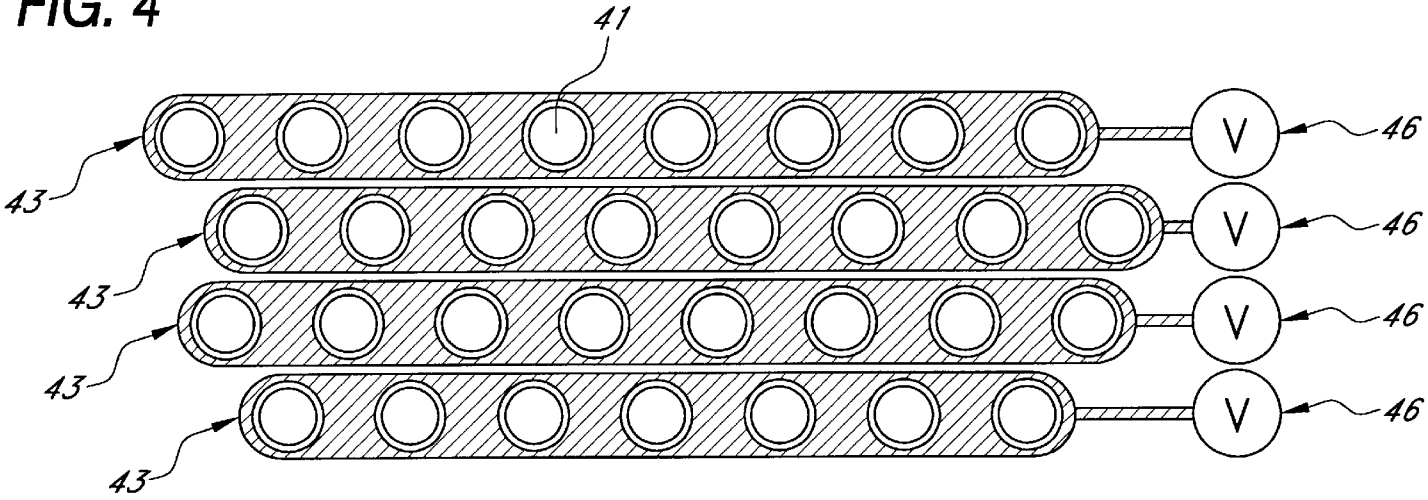
FIG. 4 is a schematic plane view of a focusing side of a printhead structure showing a plurality of conductive elements disposed in accordance with another embodiment of the present invention.

According to another embodiment of the invention, shown in FIG. 4, the second surface of the substrate layer comprises several conductive elements 43 extending along the rows of apertures 41, such that each row of apertures 41 cooperates with a specific conductive element connected to a focusing voltage source. This embodiment is particularly advantageous when the different rows of apertures 41 are located at different distances from the particle source 1. For instance, when the particle source consists of a rotating cylindrical sleeve, the different rows of apertures are not similarly spaced from the sleeve surface due to the curvature of the sleeve. In that case, the different focusing voltage sources are individually adjusted with respect to each aperture row to compensate for distance variations between the rows and the particle sources. Hereby, dot size can be controlled for each aperture regardless of the relative position with respect to the particle source.

Figure 5:
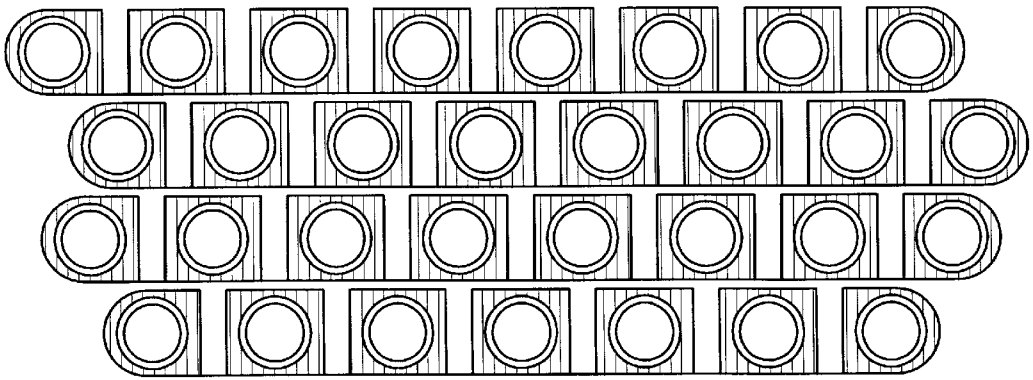
FIG. 5 is a schematic plane view of a focusing side of a printhead structure showing a plurality of conductive elements disposed in accordance with a third embodiment of the present invention.

The basic object of the present invention can be further improved using a conductive element in connection with each single aperture of the printhead structure, as shown in FIG. 5. The conductive elements are then individually connected to variable focusing voltage sources generating electric signals in accordance with the desired dot size. Hereby, the printhead structure provides individual dot size modulation in accordance with the image configuration and enables high grey scale capability.

Figure 6:
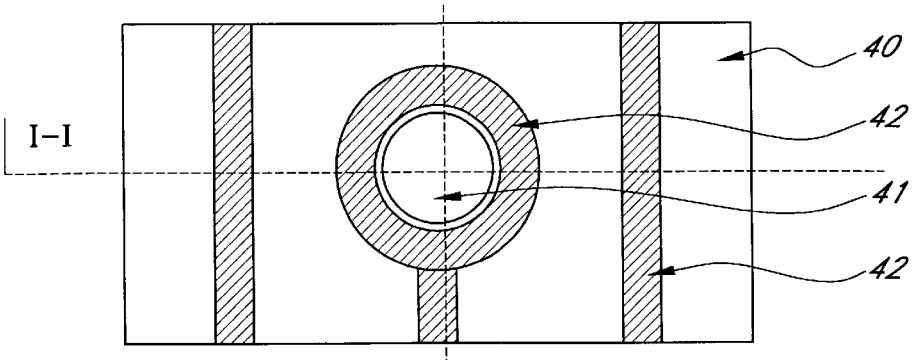
FIG. 6 is a plane view of an aperture in a printhead structure seen from the particle source.
Figure 7:
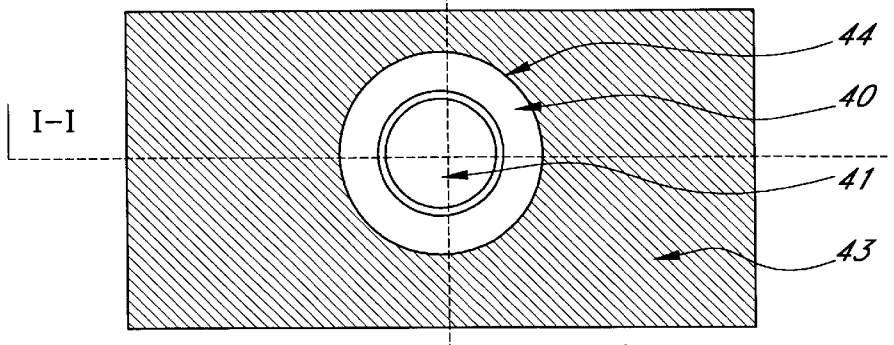
FIG. 7 is a plane view of an aperture in a printhead structure seen from the image receiving substrate.
Figure 8:
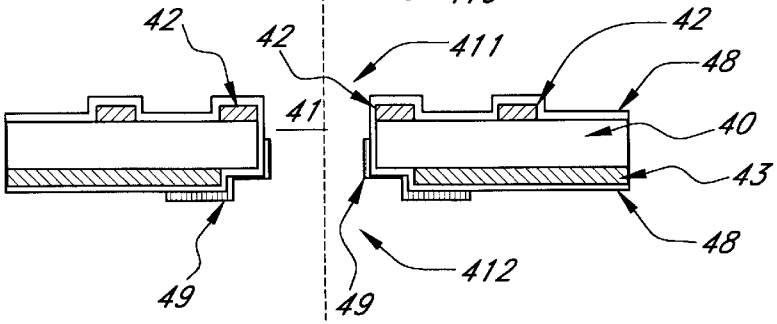
FIG. 8 is a section view of an aperture in the printhead structure across the section line I—I in FIG. 6 and FIG. 7.

A preferred geometry of an aperture 41 in the printhead structure 4 is shown in FIGS. 6, 7 and 8. Typically, the aperture 41 have a diameter in the order of 100 to 150 microns depending on manufacturing and design criteria Since a control electrode is preferably arranged symmetrically about a central axis of its corresponding aperture, an electrostatic field generated by the control electrode provides a substantially uniform distribution of charged toner particles through the aperture area Consequently, if the particle stream passing through an aperture remains unfocused, its diameter substantially corresponds to the diameter of the aperture. Furthermore, the particle stream may slightly diverge due to interaction with electrostatic fields generated by adjacent control electrodes, resulting in that the dot size may exceed the aperture size. As the conductive layer 43 is set at a focusing potential $V_f$, electric fields are produced in the openings surrounding the apertures 41. Those electric fields act to repel charged toner particles immediately after passage through an aperture 41, thereby concentrating the particle distribution about the central axis of the aperture. The focusing potential $V_f$ is a constant voltage signal or a pulse sequence, whose magnitude and/or pulse width is chosen in accordance with the desired dot size.

An aperture 41 has substantially cylindrical shape with a central axis 410 extending perpendicularly to the substrate layer 40, a first circular orifice 411 facing the particle source 1 and a second circular orifice 412 facing the image receiving substrate 3. The first orifice 411 of the aperture 41 is surrounded by a ring shaped electrode 42 arranged symmetrically about the central axis 410 of the aperture 41. The conductive layer 43 and the control electrode 42 are spaced and insulated from each other by the substrate layer 40. A protective layer 48 of electrically insulating material, such as parylene or the like, covers over the control electrode 42, the conductive layer 43 and the inner wall of the aperture 41.

A thin layer of semi-conductive material 49, such as, for example, silicon oxide, silicon dioxide, or the like, can be arranged over the protective layer 48 at least in the vicinity of the second circular orifice 412 by sputtering or by any other suitable method, in order to remove excess charge accumulation in the vicinity of the apertures due to undesired toner particle agglomeration on the printhead structure. The semi-conductive layer 49 typically has a thickness of about 10 microns.

Figure 9:
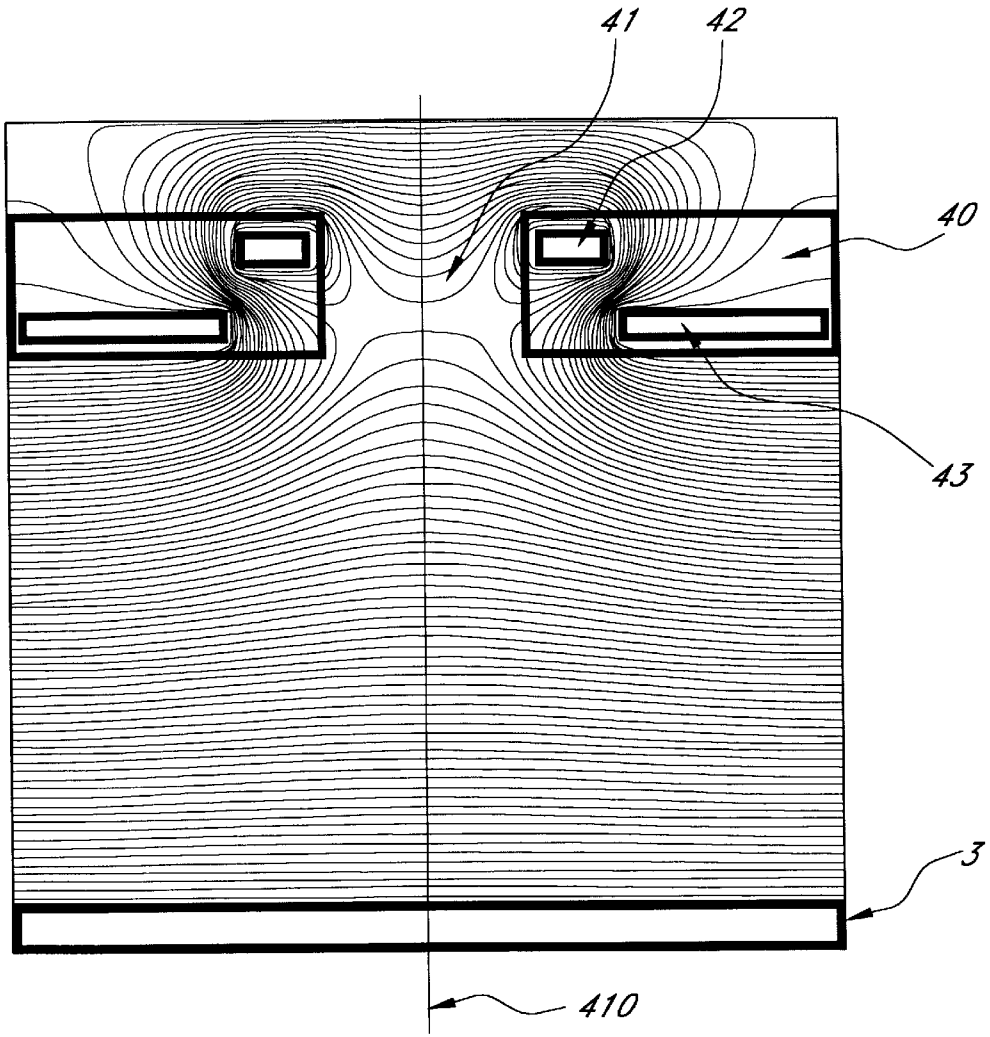
FIG. 9 is a section view of an aperture in the printhead structure showing the electric field configuration in the vicinity of the aperture, as the control electrode is set in print condition.

FIG. 9 illustrates the electric field configuration through the print zone in the vicinity of an aperture 41, as the control electrode 42 is set on print condition. The equipotential lines shown in FIG. 9 have a symmetrical configuration about the central axis 410 of the aperture 41. As is clearly apparent from FIG. 9, the focusing potential $V_f$ generated from the conductive element 43 modifies the convergence of the electrostatic field from the control electrode 42 in such a manner, that the charged toner particles passing nearest to the conductive element 43 experience a field directed obliquely toward the central axis 410 of the aperture 41 when transported toward the image receiving substrate. Accordingly, the path trajectories of the toner particles are uniformly deflected toward the central axis 410 under influence of the focusing field.

Figure 10:
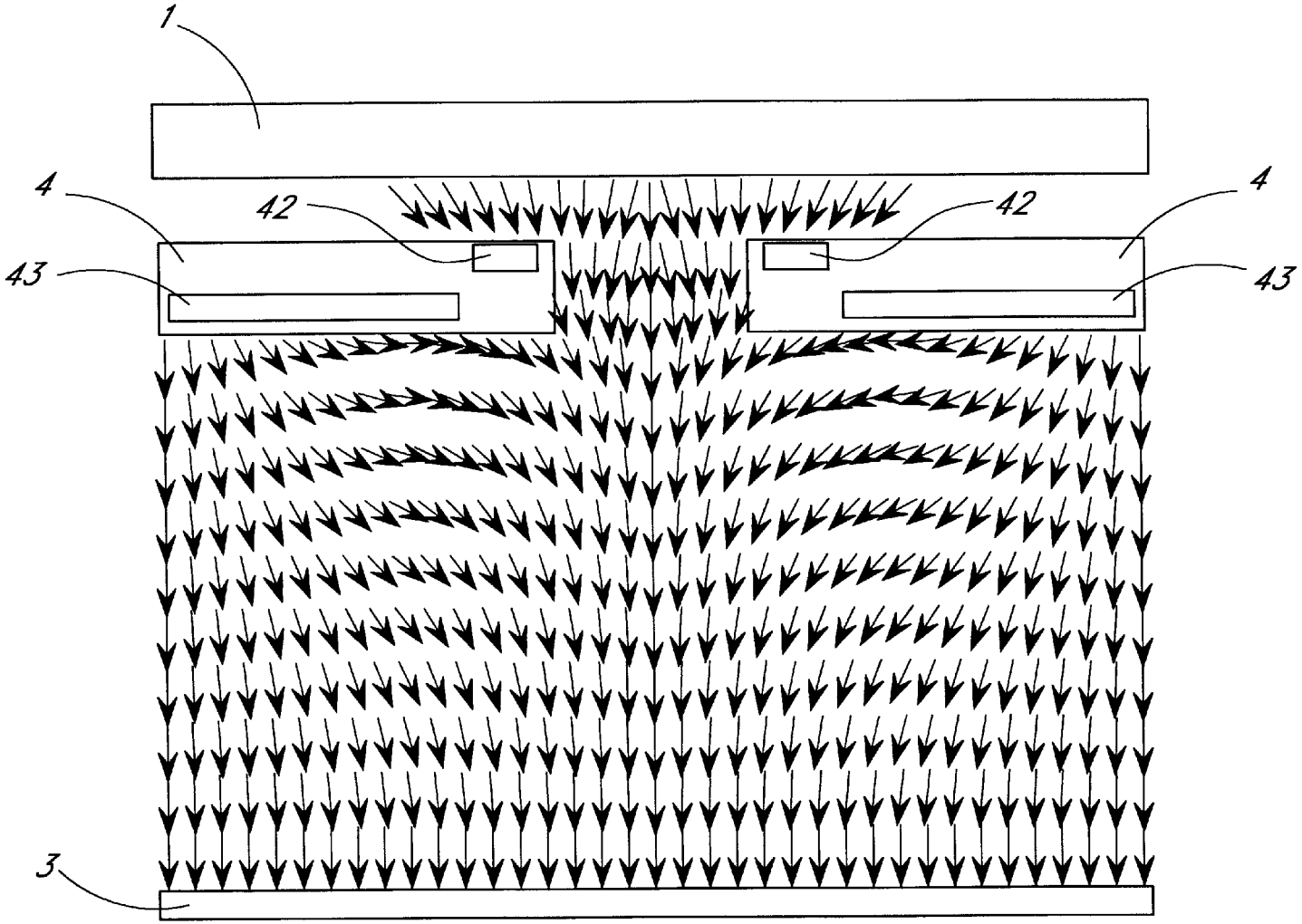
FIG. 10 is a section view of an aperture in the printhead structure showing the distribution and direction of the electric forces applied to charged toner particles, as the control electrode is set in print condition.

FIG. 10 is a schematic illustration of the distribution and direction of the electric forces applied on charged toner particles by the electric field of FIG. 9.

TEST RESULTS

Print tests have been performed using apertures arranged in the geometry shown in FIGS. 6, 7, 8 and toner particles having negative charge polarity. The aperture diameter was typically in the order of 130 microns. The printhead structure was positioned 60 microns from the particle source and 400 microns from the image receiving substrate. The control electrodes were set in print condition to a potential of 375 V, while the background voltage was set to 1200 V.

The following table shows the size of printed dots as a function of the focusing voltage $V_f$ applied to the conductive layer 43.

| | | | | | | |
|---|---|---|---|---|---|---|
| +80 V | +60 V | +40 V | +20 V | 0 V | −20 V | −40 V |
| 120 μm | 110 μm | 100 μm | 100 μm | 90 μm | 80 μm | 60 μm |

From the foregoing, it will be recognized that numerous variations and modifications may be effected without departing from the scope of the invention as defined in the appended claims.

What is claimed is:

1. An image recording device in which charged toner particles are deposited in an image configuration on an image receiving substrate, comprising:

a particle source arranged adjacent to a back electrode wherein an image receiving substrate can be interposed between the particle source and the back electrode;

a background voltage source connected to the back electrode to produce an electric field between the particle source and the back electrode;

a printhead structure arranged between the particle source and the image receiving substrate for controlling the transport of charged toner particles from the particle source, said printhead structure comprising:

an array of addressable control electrodes connected to variable voltage sources to produce a pattern of electrostatic fields which, in response to control in accordance with the image configuration, influence the electric field from the back electrode in order to selectively permit or restrict transport of charged toner particles from the particle source toward the image receiving substrate; and at least one set of focusing means arranged in electric cooperation with said control electrodes to apply converging forces on charged toner particles between the control electrodes and the image receiving substrate to control a toner dot size.

2. A printhead structure for controlling the transport of charged toner particles from a particle source to an image receiving substrate, comprising:

a plurality of apertures arranged through the printhead structure;

at least one control electrode arranged in connection with each aperture to produce electrostatic fields which, in response to control in accordance with the image configuration, permit or restrict passage of charged toner particles through the corresponding aperture; and at least one conductive element connected to a focusing voltage source to apply converging forces on charged toner particles between the aperture and the image receiving substrate in order to control a toner dot size and to reduce scattering of charged toner particles transported toward the image receiving substrate.

3. The printhead structure as defined in claim 2, further including a substrate layer having a first surface facing the particle source and a second surface facing the image receiving substrate, wherein:

the apertures are arranged through the substrate layer;

the control electrodes are arranged on said first surface of the substrate layer such that each aperture in the substrate layer is at least partially surrounded by a control electrode; and at least one conductive element is arranged on said second surface of the substrate layer.

4. The printhead structure as defined in claim 3, wherein the substrate layer comprises an electrically insulating material.

5. The printhead structure as defined in claim 3, wherein the substrate layer is made of nonrigid, flexible material.

6. The printhead structure as defined in claim 3, wherein the apertures are arranged in at least two parallel rows extending across the substrate layer.

7. The printhead structure as defined in claim 3, wherein the conductive element is an electrode plate having a plurality of openings each of which is related to a corresponding aperture.

8. The printhead structure as defined in claim 3, wherein the conductive element is an electrode plate having a plurality of openings each of which surrounds a corresponding aperture.

9. The printhead structure as defined in claim 3, including at least two conductive elements each of which is related to a corresponding row of apertures.

10. The printhead structure as defined in claim 3, including a plurality of conductive elements each of which is related to a corresponding aperture.

11. The printhead structure as defined in claim 10, in which the layer of electrically insulating material is a thin film of parylene.

12. The printhead structure as defined in claim 3, wherein each conductive element comprises an electrode plate having a plurality of openings each of which is arranged symmetrically about a central axis of an aperture.

13. The printhead structure as defined in claim 12, in which the layer of electrically insulating material is a thin film of parylene.

14. The printhead structure as defined in claim 3, wherein each conductive element is connected to a focusing voltage source producing an electric field about the central axis of each aperture in the substrate layer, said electric field acting to repel charged toner particles passing through the aperture, thereby causing said charged toner particles to converge about said central axis of the aperture.

15. The printhead structure as defined in claim 14, in which the layer of electrically insulating material is a thin film of parylene.

16. The printhead structure as defined in claim 3, further including a layer of electrically insulating material arranged on the first surface of the substrate layer and covering the array of control electrodes.

17. The printhead structure as defined in claim 3, further including a layer of electrically insulating material arranged on the second surface of the substrate layer and covering the conductive element.

18. The printhead structure as defined in claim 3, further including a layer of electrically insulating material arranged on an inner wall of the apertures.

19. The printhead structure as defined in claim 3, wherein each aperture has a central axis extending perpendicular to the image receiving substrate.

20. The printhead structure as defined in claim 3, further including a layer of semiconductive material at least partially coating the surface of the printhead structure facing the image receiving substrate.

21. An image recording method in which charged toner particles are deposited in an image configuration on an information carrier, comprising the steps of:

conveying the charged toner particles to a particle source adjacent to a back electrode;

connecting a background voltage source to the back electrode to produce an attractive electric field on the charged toner particles;

connecting variable voltage sources to an array of control electrodes to produce a pattern of electrostatic fields which interact with said attractive electric field from the back electrode to selectively permit or restrict the transport of charged particles from the particle source; and connecting at least one voltage source to an array of focusing electrodes to apply converging forces on the transported charged particles between the array of control electrodes and the information carrier to control a toner dot size.

* * * * *